US009114367B1

(12) United States Patent
Thomas et al.

(10) Patent No.: US 9,114,367 B1
(45) Date of Patent: Aug. 25, 2015

(54) APPARATUS FOR MIXING FLUIDS

(75) Inventors: Dalton Thomas, Houston, TX (US); Steve Reesman, Houston, TX (US)

(73) Assignee: ALFA LAVAL VORTEX, INC., Houston, TX (US)

( * ) Notice: Subject to any disclaimer, the term of this patent is extended or adjusted under 35 U.S.C. 154(b) by 155 days.

(21) Appl. No.: 13/346,486

(22) Filed: Jan. 9, 2012

(51) Int. Cl.
*B01F 5/04* (2006.01)

(52) U.S. Cl.
CPC ..... *B01F 5/0426* (2013.01)

(58) Field of Classification Search
CPC .... B01F 5/0413; B01F 5/0415; B01F 5/0416; B01F 5/0425; B01F 5/0426; B01F 5/0428; B01F 5/043
USPC ..... 366/101, 106, 107, 136, 137, 163.2, 366/165.1, 165.4
See application file for complete search history.

(56) References Cited

U.S. PATENT DOCUMENTS

| | | | | | |
|---|---|---|---|---|---|
| 1,015,822 | A | * | 1/1912 | Mueller | 261/76 |
| 2,198,998 | A | * | 4/1940 | Honsberger | 239/417 |
| 2,730,190 | A | | 1/1956 | Brown et al. | |
| 2,730,240 | A | | 1/1956 | Johnson | |
| 3,251,550 | A | * | 5/1966 | Muschelknautz et al. | 239/4 |
| 4,157,304 | A | * | 6/1979 | Molvar | 210/220 |
| 4,186,772 | A | * | 2/1980 | Handleman | 137/891 |
| 4,527,716 | A | | 7/1985 | Haas et al. | |
| 5,020,858 | A | | 6/1991 | Nishikawa | |
| 5,073,310 | A | * | 12/1991 | Ramsey | 261/76 |
| 5,139,625 | A | * | 8/1992 | Tanaka et al. | 205/633 |
| 5,163,830 | A | * | 11/1992 | Pfefferkorn | 431/355 |
| 5,169,293 | A | * | 12/1992 | Yamamoto | 417/179 |
| 5,171,090 | A | * | 12/1992 | Wiemers | 366/163.2 |
| 5,245,977 | A | * | 9/1993 | Chen et al. | 123/590 |
| 5,277,492 | A | * | 1/1994 | Paul | 366/101 |
| 5,382,411 | A | | 1/1995 | Allen | |
| 5,447,394 | A | | 9/1995 | Shepard | |
| 5,507,237 | A | | 4/1996 | Barrow et al. | |
| 5,642,939 | A | | 7/1997 | Comardo | |
| 5,664,733 | A | * | 9/1997 | Lott | 239/429 |
| 5,722,552 | A | | 3/1998 | Olson | |
| 5,811,013 | A | | 9/1998 | Ito | |
| 6,024,874 | A | | 2/2000 | Lott | |
| 6,223,903 | B1 | | 5/2001 | Mansouri | |
| 6,357,906 | B1 | | 3/2002 | Baudoin et al. | |
| 6,796,704 | B1 | | 9/2004 | Lott | |
| 6,986,506 | B2 | * | 1/2006 | Chapman et al. | 261/76 |
| 6,994,276 | B2 | * | 2/2006 | Faye et al. | 239/421 |
| 7,029,165 | B2 | * | 4/2006 | Allen | 366/163.2 |
| 7,048,432 | B2 | | 5/2006 | Phillippi et al. | |
| 7,059,591 | B2 | * | 6/2006 | Bortkevitch et al. | 261/76 |

(Continued)

FOREIGN PATENT DOCUMENTS

| | | |
|---|---|---|
| WO | WO9709123 | 3/1997 |

*Primary Examiner* — David Sorkin
*Assistant Examiner* — Abbas Rashid
(74) *Attorney, Agent, or Firm* — Buskop Law Group, PC; Wendy Buskop

(57) ABSTRACT

An apparatus for mixing fluids can provide at least three times a volumetric flow of a volumetric flow rate of a pump to have a specific volumetric flow rate. The apparatus can include a mixing housing, an inner cavity, and an inlet nozzle adjacent a first end of the mixing housing and at least partially extending into the inner cavity. The apparatus can also include a radial inlet formed through a portion of the mixing housing and an outlet adjacent a second end of the mixing housing. The apparatus can form a portion of a system for mixing fluids, separating fluids, or both.

10 Claims, 6 Drawing Sheets

(56) References Cited

U.S. PATENT DOCUMENTS

| | | | | |
|---|---|---|---|---|
| 7,401,973 | B1 | 7/2008 | Lott | |
| 7,618,182 | B1 | 11/2009 | Lott | |
| 7,622,036 | B2 * | 11/2009 | Morse | 210/86 |
| 7,635,218 | B1 | 12/2009 | Lott | |
| 7,726,870 | B1 | 6/2010 | Lott | |
| 7,926,502 | B1 | 4/2011 | Lott | |
| 8,087,816 | B2 * | 1/2012 | Sisk | 366/101 |
| 2004/0056112 | A1 * | 3/2004 | Faye et al. | 239/424 |
| 2004/0091406 | A1 * | 5/2004 | Wolfert et al. | 422/224 |
| 2004/0190368 | A1 * | 9/2004 | Allen | 366/152.1 |
| 2004/0217491 | A1 * | 11/2004 | Chapman et al. | 261/76 |
| 2005/0058020 | A1 | 3/2005 | Lott | |
| 2005/0077636 | A1 * | 4/2005 | Bortkevitch et al. | 261/76 |
| 2005/0109697 | A1 | 5/2005 | Olivier | |
| 2005/0111298 | A1 | 5/2005 | Lott | |
| 2006/0027938 | A1 * | 2/2006 | Chapman et al. | 261/76 |
| 2006/0070675 | A1 * | 4/2006 | Hsu | 137/888 |

* cited by examiner

APPARATUS FOR MIXING FLUIDS

FIELD

The present embodiments generally relate to an apparatus for mixing fluids.

BACKGROUND

A need exists for an apparatus for mixing fluids that can increase a volume of fluid moved by at least three times over a volumetric flow rate of a pump.

A further need exists for an apparatus for mixing fluids that can decrease an amount of time needed to turnover a vessel, such as a mixing tank.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an apparatus for mixing fluids.

The apparatus for mixing fluids can include a mixing housing. The mixing housing can have an inner cavity. The mixing housing can have a central axis, a first end, and a second end. At least a portion of the mixing housing can diverge from the first end to the second end.

The apparatus for mixing fluids can include an inlet nozzle adjacent the first end of the mixing housing. The inlet nozzle can extend at least partially into the inner cavity. The inlet nozzle can have an inlet central axis axially aligned with the central axis of the mixing housing. The inlet nozzle can be integral with the mixing housing or connected with the mixing housing.

In one or more embodiments, the inlet nozzle can include a nozzle inlet end adjacent a converging section thereof and a nozzle outlet end adjacent a diverging section thereof. The diverging section of the inlet nozzle can have an angle of up to fifteen degrees.

In one or more embodiments, the inlet nozzle can have a nozzle inlet end adjacent the converging section and a nozzle outlet end adjacent a straight section thereof.

The converging section of the inlet nozzle can be formed using a convex shape tangent to an inside diameter of the inlet nozzle.

The apparatus for mixing fluids can include one or more radial inlets formed into at least one wall of the mixing housing. Each radial inlet can have a radial inlet axis at an acute angle to the central axis of the mixing housing. Each radial inlet axis can be spiraled.

The inlet nozzle and radial inlet can be configured to provide fluid to the inner cavity and create a spiraling turbulent flow of the fluid.

An outlet can be adjacent the second end of the mixing housing. The outlet can have an outlet central axis axially aligned with the central axis of the mixing housing.

One or more embodiments of the apparatus for mixing fluids can be used in a system for mixing fluids, separating fluids, or both.

The system can include a vessel having a cavity configured to contain a fluid. The vessel can be used for mixing the fluid, separating the fluid, or both.

The apparatus for mixing fluids can be disposed at least partially in the cavity of the vessel. The apparatus for mixing fluids can be suspended from a pipe of the vessel, attached to a manifold in the vessel, or otherwise operatively disposed in the cavity of the vessel. The apparatus for mixing fluids can be disposed through a wall of the vessel, connected with a wall of the vessel, or combinations thereof.

Figure 1:
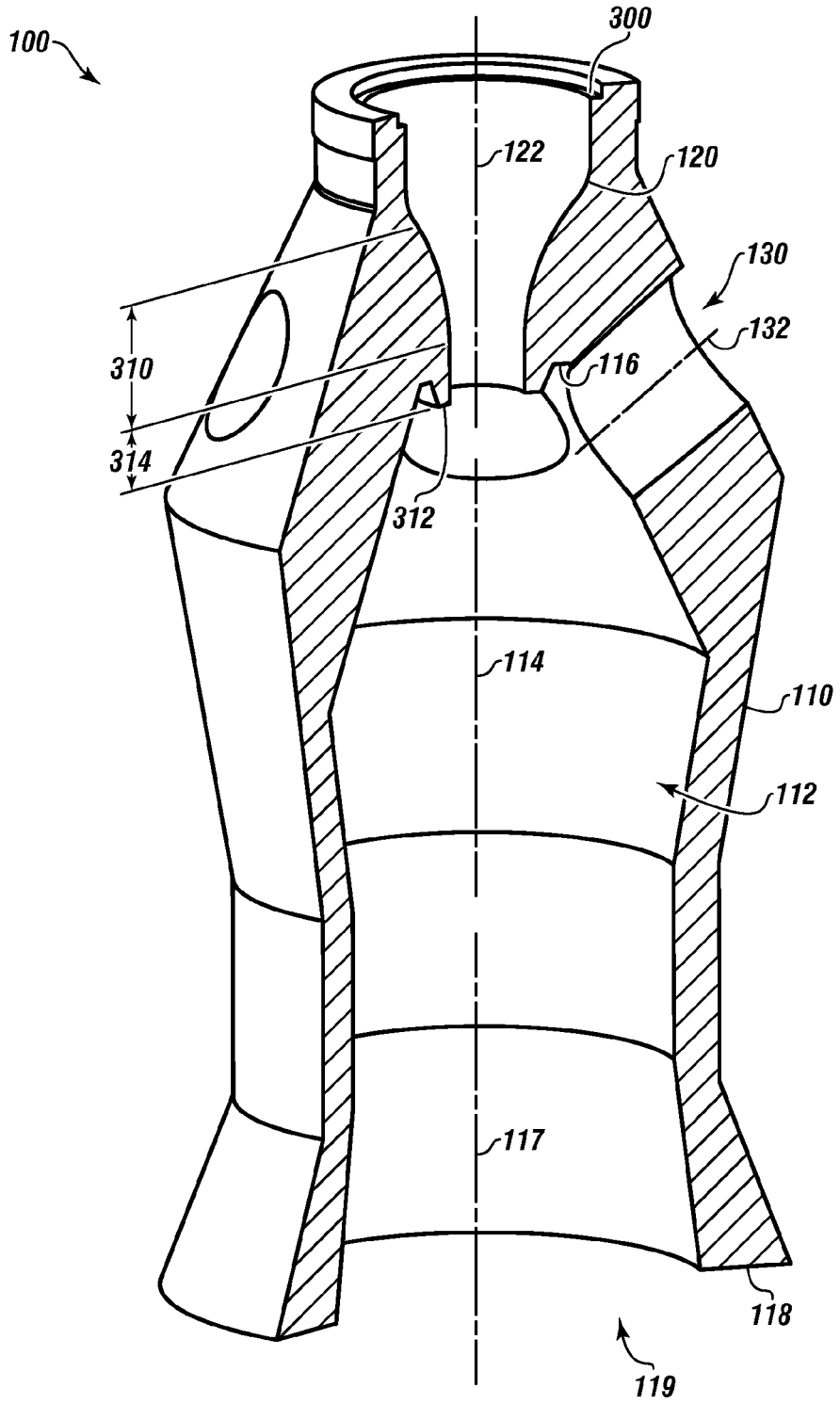
FIG. 1 depicts an isometric view of an embodiment of the apparatus for mixing fluids having a converging-to-straight nozzle.
Figure 2:
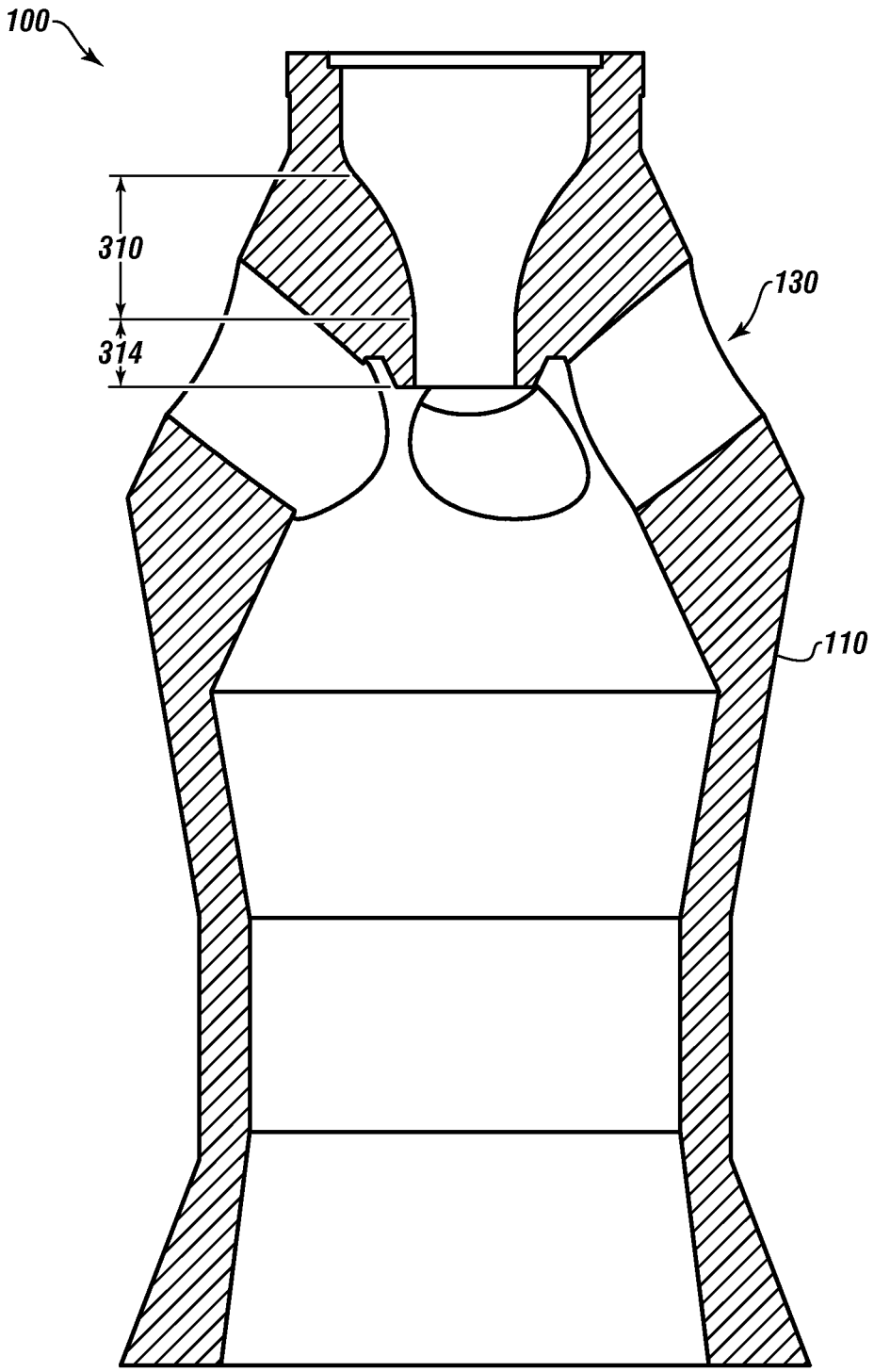
FIG. 2 depicts a cross sectional view of the apparatus for mixing fluids of FIG. 1 having the converging-to-straight nozzle.

Turning now to the Figures, FIG. 1 depicts an isometric view of an embodiment of the apparatus for mixing fluids 100 having a converging-to-straight nozzle. FIG. 2 depicts a cross sectional view of the apparatus for mixing fluids 100 of FIG. 1 having the converging-to-straight nozzle.

The apparatus for mixing fluids 100 can include a mixing housing 110. The mixing housing 110 can include an inner cavity 112 and a central axis 114.

The mixing housing 110 can have a first end 116 and a second end 118. At least a portion of the mixing housing 110 can diverge from the first end 116 to the second end 118.

An inlet nozzle 120 can be adjacent to the first end 116 of the mixing housing 110. The inlet nozzle 120 can extend at least partially into the inner cavity 112. The inlet nozzle 120 can have an inlet central axis 122 axially aligned with the central axis 114 of the mixing housing 110.

The inlet nozzle 120 can include a nozzle inlet end 300 adjacent a converging section 310 of the inlet nozzle 120 and a nozzle outlet end 312 adjacent a straight section 314 of the inlet nozzle 120. The converging section 310 of the inlet nozzle 120 and the straight section 314 of the inlet nozzle 120 can form the apparatus for mixing fluids 100 having a converging-to-straight nozzle.

A radial inlet 130 can be formed into at least one wall of the mixing housing 110. The radial inlet 130 can have a radial inlet axis 132 at an acute angle to the central axis 114 of the mixing housing 110. The inlet nozzle 120 can extend into the inner cavity 112 to at least thirty three percent of a distance between the first end 116 and the radial inlet axis 132.

The inlet nozzle 120 and radial inlet 130 can be configured to provide fluid to the inner cavity 112 and create a spiraling turbulent flow of the fluid.

An outlet 119 can be adjacent to the second end 118 of the mixing housing 110. The outlet 119 can have an outlet central axis 117 axially aligned with the central axis 114 of the mixing housing 110.

Figure 3:
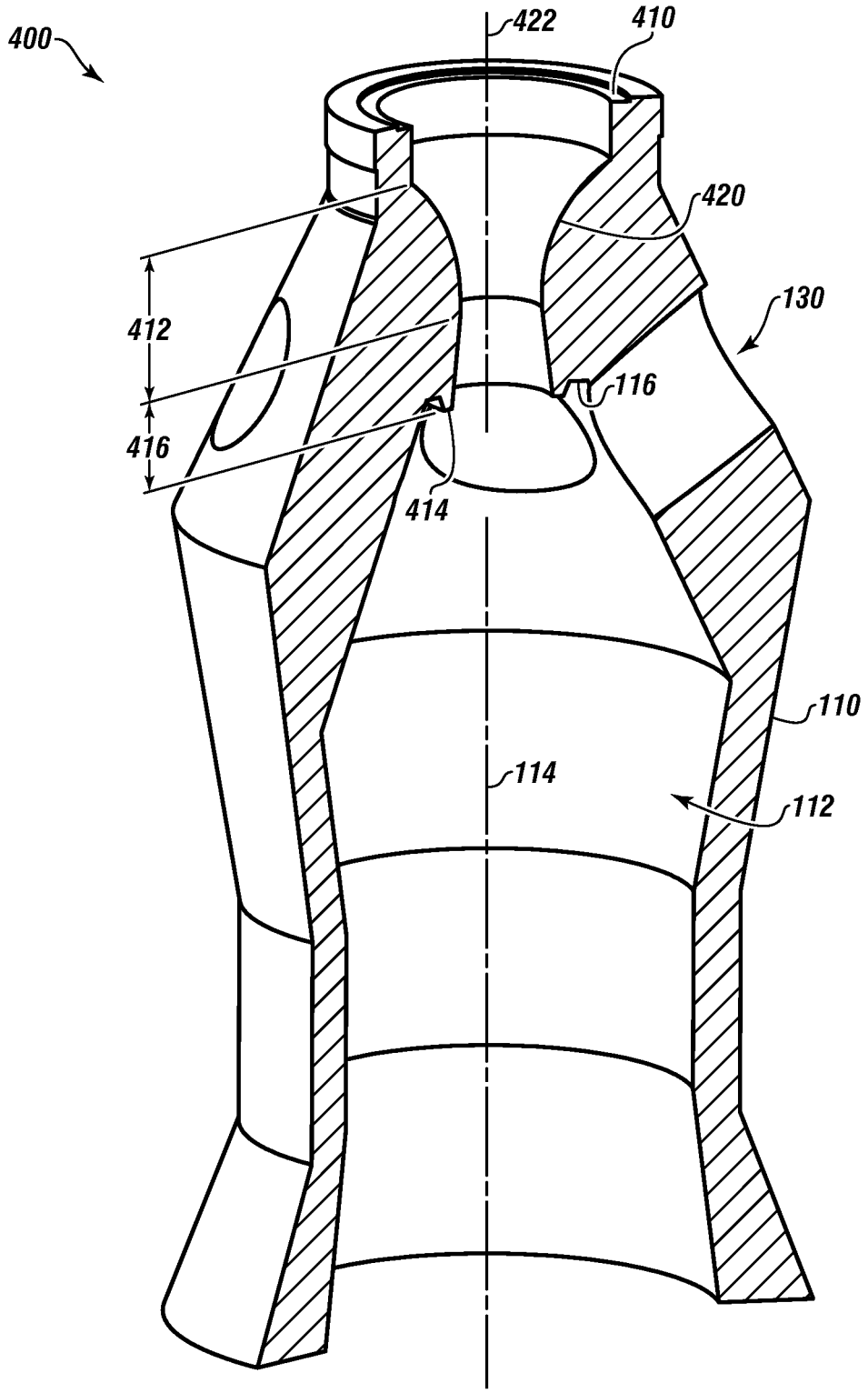
FIG. 3 depicts an isometric view of an embodiment of the apparatus for mixing fluids having a converging-to-diverging nozzle.
Figure 4:
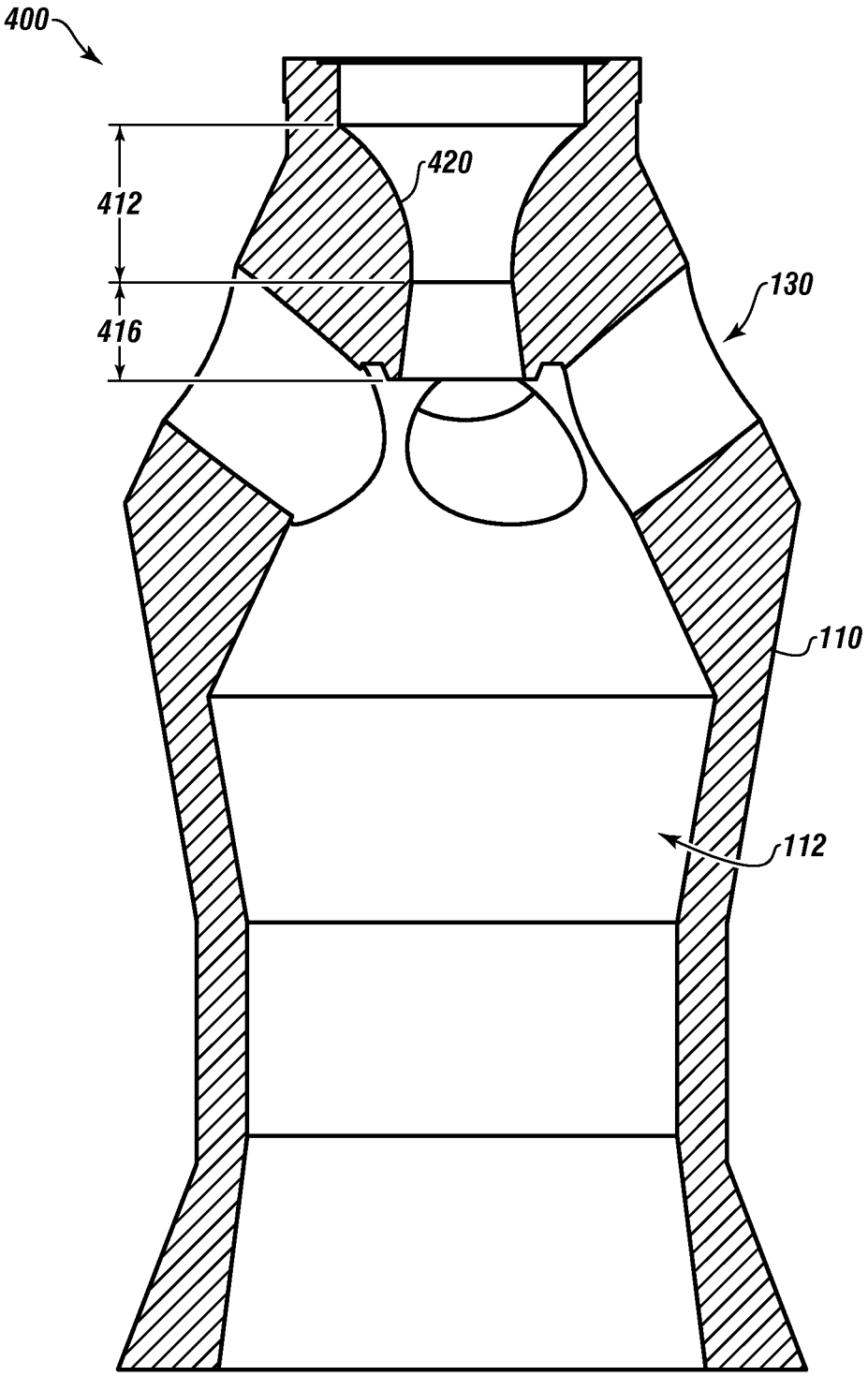
FIG. 4 depicts a cross sectional view of the apparatus for mixing fluids of apparatus for mixing fluids of FIG. 3 having the converging-to-diverging nozzle.

FIG. 3 depicts an isometric view of an embodiment of the apparatus for mixing fluids 400 having a converging-to-diverging nozzle. FIG. 4 depicts a cross sectional view of the apparatus for mixing fluids 400 of FIG. 3 having the converging-to-diverging nozzle.

The apparatus for mixing fluids 400 can include the mixing housing 110.

An inlet nozzle 420 can be adjacent to the first end 116 of the mixing housing 110. The inlet nozzle 420 can extend at least partially into the inner cavity 112. The inlet nozzle 420 can have an inlet central axis 422 axially aligned with the central axis 114 of the mixing housing 110.

The inlet nozzle 420 can have a nozzle inlet end 410 adjacent a converging section 412 of the inlet nozzle 420 and a nozzle outlet end 414 adjacent a diverging section 416 of the inlet nozzle 420. The converging section 412 of the inlet nozzle 420 and the diverging section 416 of the inlet nozzle 420 can form the apparatus for mixing fluids 400 having a converging-to-diverging nozzle.

One or more radial inlets 130 can be formed into the mixing housing 110.

Figure 5:
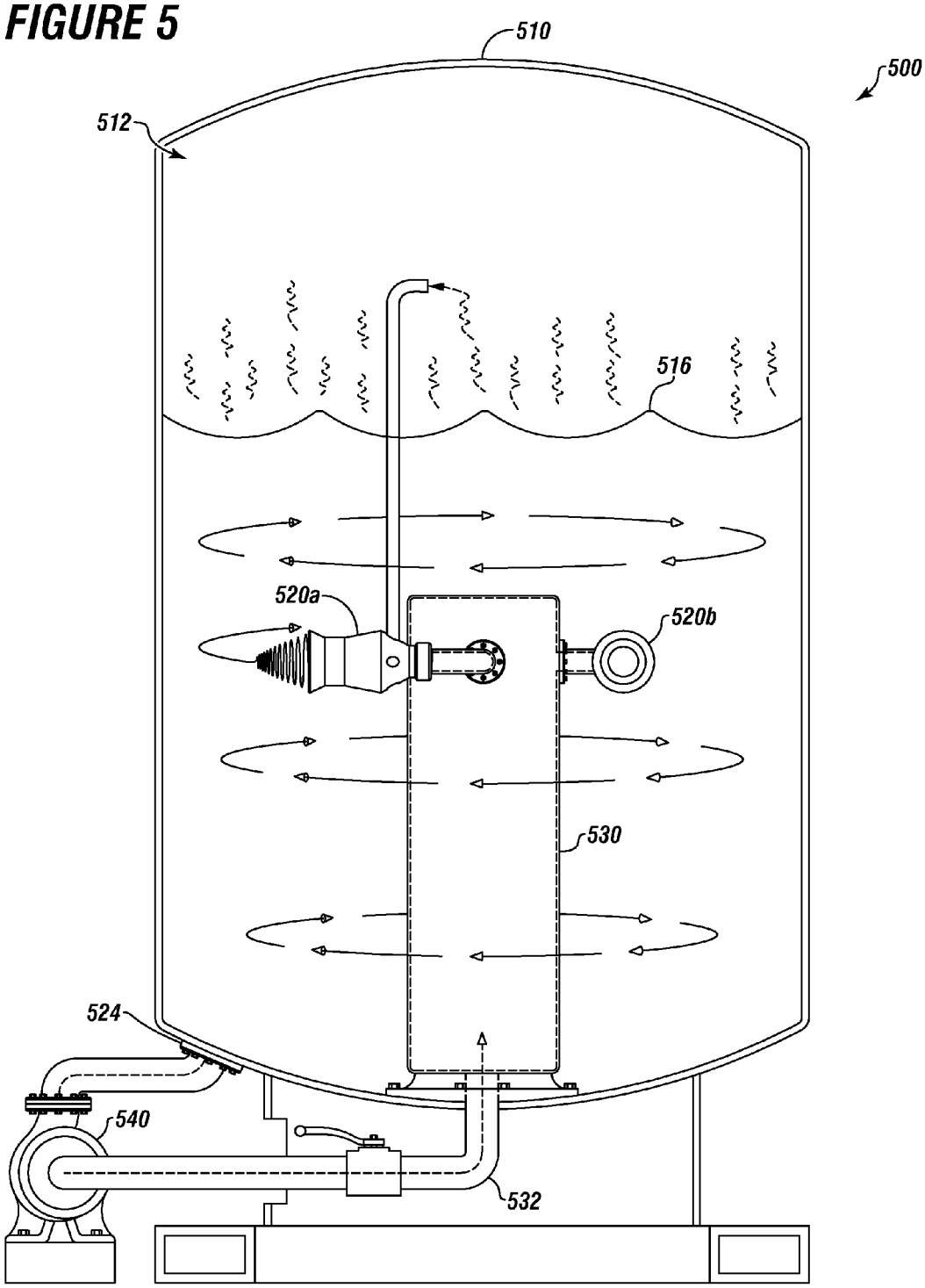
FIG. 5 depicts a system for mixing fluids, separating fluids, or both having an embodiment of the apparatus for mixing fluids disposed within a vessel thereof.

FIG. 5 depicts an embodiment of a system for mixing fluids, separating fluids, or both 500 having an embodiment of the apparatus for mixing fluids 520*a* and 520*b* disposed within a vessel 510 thereof.

The system for mixing fluids, separating fluids, or both 500 can include the vessel 510. The vessel 510 can be a tank, a mixing tank, a container, or other device capable of containing a fluid.

The vessel 510 can have a cavity 512 configured to contain a fluid 516. The fluid 516 can be drilling mud, chemicals, water, or combinations thereof.

One or more of the apparatus for mixing fluids 520*a* and 520*b* can be disposed at least partially in the cavity 512. The apparatus for mixing fluids 520*a* and 520*b* can be substantially similar to any apparatus for mixing fluids disclosed herein.

The apparatus for mixing fluids 520*a* and 520*b* can be connected with a manifold 530 that can be suspended by a pipe 532 in communication, via a pump 540, with a drain 524. The drain 524 can be located in the bottom of the vessel 510.

In operation, the fluid 516 can be extracted from the vessel 510 through the drain 524. The pump 540 can move the fluid 516 from the drain 524, through the pipe 532, and into the manifold 530. The fluid 516 can flow back into the vessel 510 via at least one of the apparatus for mixing fluids 520*a* and 520*b*.

Each of the apparatus for mixing fluids 520*a* and 520*b* can increase the volumetric flow rate of the fluid 516 in the vessel 510 by at least three times. For example, if the pump 540 is a one hundred gallons per minute (gpm) pump, then the apparatus for mixing fluids 520*a* and/or 520*b* can provide a volumetric flow rate of 600 gpm within the vessel 510. The volumetric flow within the vessel 510 can be formed by the unique combination of the radial inlets, positions of the inlet nozzles, and shapes of the inlet nozzles of the apparatus for mixing fluids 520*a* and 520*b*.

Figure 6:
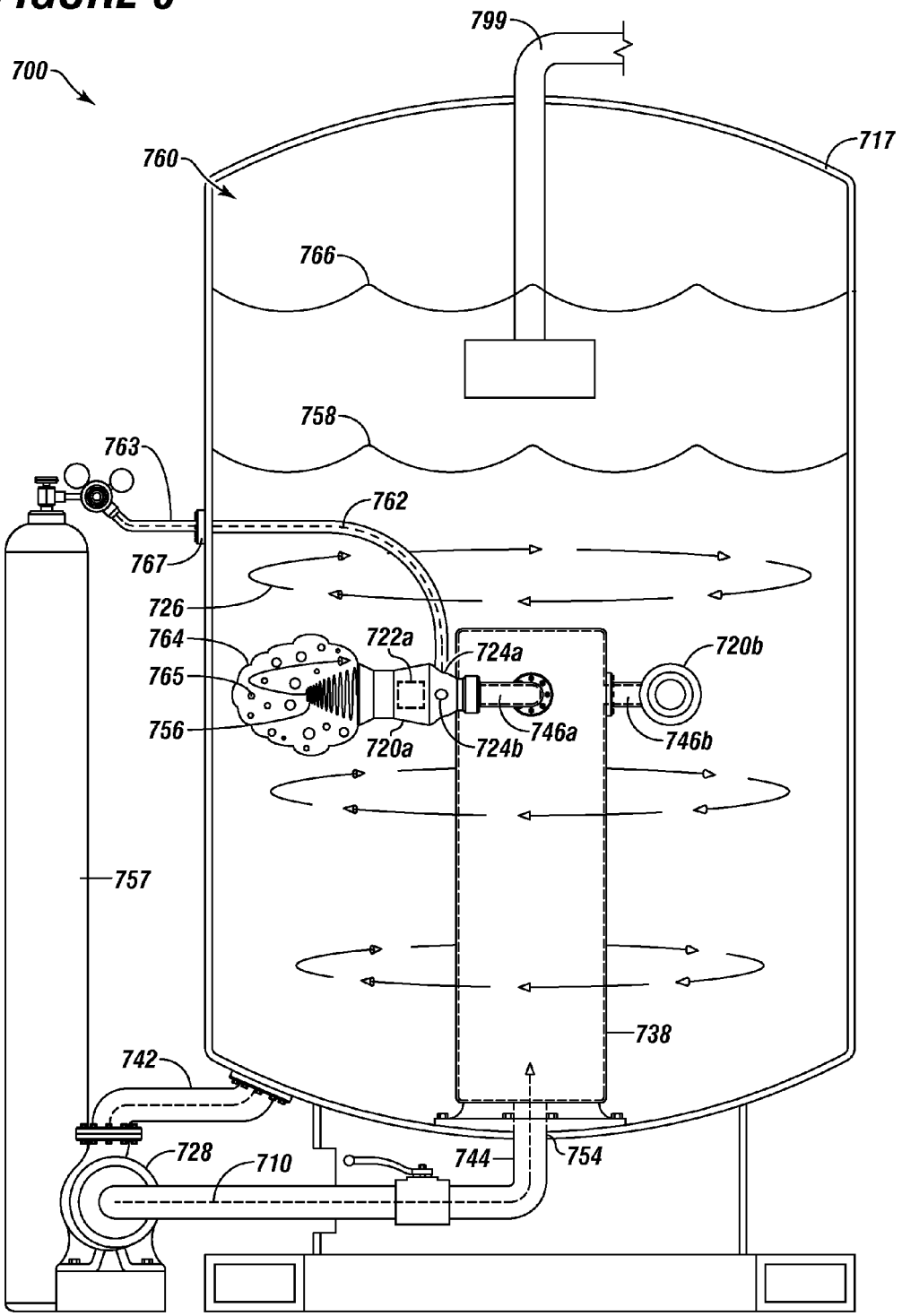
FIG. 6 depicts another system for mixing fluids, separating fluids, or both having an embodiment of the apparatus for mixing fluids disposed within the vessel thereof.

FIG. 6 depicts another system for mixing fluids, separating fluids, or both 700 having a plurality of apparatus for mixing fluids 720*a* and 720*b* disposed within a vessel 717 thereof.

A fluid 760 can be disposed within the vessel 717, such as a tank, at a level that completely covers the plurality of apparatus for mixing fluids 720*a* and 720*b* that are disposed within the vessel 717.

The plurality of apparatus for mixing fluids 720*a* and 720*b* can be in fluid communication with a manifold 738 through a plurality of secondary conduits 746*a*-746*b*.

The manifold 738, which can be disposed within the vessel 717, can be in fluid communication with an external energy source 728 through a central conduit 744. The central conduit 744 can pass into the vessel 717 through a bottom port 754.

The external energy source 728 can be in fluid communication with a motive fluid stream pipe 742, which can be in fluid communication with the vessel 717.

The external energy source 728 can draw in the fluid 760, which can be an oil and water mixture, through the motive fluid stream pipe 742, and can pressurize the fluid 760; thereby forming a motive fluid stream 710.

The motive fluid stream 710 can flow from the external energy source 728, through the central conduit 744, into the manifold 738, through the plurality of secondary conduits 746*a* and 746*b*, and into the plurality of apparatus for mixing fluids 720*a* and 720*b*.

An air 762 can be introduced into the plurality of apparatus for mixing fluids 720*a* and 720*b*. The air 762 can exit an air source 757, pass through an air pipe 763 in fluid communication with one or more induction ports 724*a* and 724*b* of at least one of the plurality of apparatus for mixing fluids 720*a* and 720*b*, and pass into the plurality of apparatus for mixing fluids 720*a* and 720*b*. The air pipe 763 can pass into the vessel 717 through an air pipe inlet 767.

The motive fluid stream 710 can be pressurized and have a first flow rate as it passes into the plurality of apparatus for mixing fluids 720*a* and 720*b* by use of the external energy source 728.

A low pressure mixture 756 can be formed proximate the plurality of apparatus for mixing fluids 720*a* and 720*b* when the motive fluid stream 710 is expelled from the plurality of apparatus for mixing fluids 720*a* and 720*b*.

A high pressure mixture 764 with entrained air bubbles 765 can be formed by drawing the low pressure mixture 756 into the plurality of apparatus for mixing fluids 720*a* and 720*b* through the induction ports 724*a* and 724*b*, aspirating or pressurizing the air 762 through at least one of the induction ports 724*a* and 724*b*, and mixing the air 762 with the low pressure mixture 756 within the plurality of apparatus for mixing fluids 720*a* and 720*b*, such as within a mixing chamber 722*a* thereof; thereby allowing a first portion 766 of the fluid 760, such as oil, to attach to the entrained air bubbles 765. For example, the mixing chamber 722*a* can be the inner cavity of the apparatus for mixing fluids 720*a*.

A continuous turbulence 726 can be formed in the fluid 760 by the plurality of apparatus for mixing fluids 720*a* and 720*b*.

The first portion 766 of the fluid 760 can be disposed above a second portion 758 of the fluid 760, such as a liquid surface in the vessel 717; thereby allowing the first portion 766 of the fluid 760 to be removed through a vent pipe 799.

The unique structure of the apparatus for mixing fluids 720*a* and 720*b* can provide for more efficient mixing.

Simulations were run on different embodiments of the apparatus for mixing fluids and surprising unexpected results were received, as detailed below in examples. The simulations were performed using AUTODESK® SIMULATION CRD software, formerly known as CF DESIGN®.

Example 1

A first simulation was for a conventional apparatus for mixing. The first simulation was run with different gallon per minute pumps. Results of the first simulation are in Table 1.

TABLE 1

| noz type/ inlet pressure | NOZ VELOCITY | DICHG VELOCITY | PRESS @ 2" INLET | flow @ ind port | flow @ discharge | flow multiplier |
|---|---|---|---|---|---|---|
| ORG RND 0.88 @ 125 GPM | 67 | 7.6 | 28 | 52.5 | 335 | 2.68 |
| ORG RND 0.88 @ 150 GPM | 80.6 | 8.7 | 40.7 | 59 | 387 | 2.58 |
| ORG RND 0.88 @ 175 GPM | 94 | 10.3 | 56 | 69 | 452 | 2.58 |
| ORG RND 0.88 @ 200 GPM | 107 | 10.9 | 74 | 70 | 481 | 2.41 |

Example 2

A second simulation was for a nozzle at least partially protruding into a mixing chamber of the apparatus for mixing fluids. The second simulation was run with different gallon per minute pumps. Results of the second simulation are in Table 2.

TABLE 2

| noz type/ inlet pressure | NOZ VELOCITY | DICHG VELOCITY | PRESS @ 2" INLET | flow @ ind port | flow @ discharge | flow multiplier |
|---|---|---|---|---|---|---|
| MOD-3 RND 0.88 @ 125 GPM | 67 | 7 | 30 | 63 | 353 | 2.82 |
| MOD-3 RND 0.88 @ 150 GPM | 80.4 | 8.4 | 44 | 62 | 402 | 2.68 |
| MOD-3 RND 0.88 @ 175 GPM | 93 | 9.7 | 60 | 73 | 472 | 2.70 |
| MOD-3 RND 0.88 @ 200 GPM | 108 | 11.6 | 75 | 78 | 516 | 2.58 |

Example 3

A third simulation was for a nozzle at least partially protruding into the mixing chamber of the apparatus for mixing fluids using a nozzle inlet as depicted in FIGS. 1 and 2. The third simulation was run with different gallon per minute pumps. Results of the third simulation are in Table 3.

TABLE 3

| noz type/ inlet pressure | NOZ VELOCITY | DICHG VELOCITY | PRESS @ 2" INLET | flow @ ind port | flow @ discharge | flow multiplier |
|---|---|---|---|---|---|---|
| MOD-3A RND 0.88 @ 125 GPM | 67 | 7.5 | 30 | 63 | 378 | 3.02 |
| MOD-3A RND 0.88 @ 150 GPM | 80.4 | 7.5 | 43 | 71 | 435 | 2.90 |
| MOD-3A RND 0.88 @ 175 GPM | 93 | 10 | 61 | 85 | 516 | 2.95 |

TABLE 3-continued

| noz type/ inlet pressure | NOZ VELOCITY | DICHG VELOCITY | PRESS @ 2" INLET | flow @ ind port | flow @ discharge | flow multiplier |
|---|---|---|---|---|---|---|
| MOD-3A RND 0.88 @ 200 GPM | 108 | 12 | 74 | 86 | 544 | 2.72 |

Example 4

A fourth simulation was for a nozzle at least partially protruding into the mixing chamber of the apparatus for mixing fluids using a nozzle inlet as depicted in FIGS. 3 and 4. The fourth simulation was run with different gallon per minute pumps. Results of the fourth simulation are in Table 4.

TABLE 4

| noz type/ inlet pressure | NOZ VELOCITY | DICHG VELOCITY | PRESS @ 2" INLET | flow @ ind port | flow @ discharge | flow multiplier |
|---|---|---|---|---|---|---|
| MOD-3B RND 0.88 @ 125 GPM | 68 | 7.5 | 30 | 64 | 381 | 3.05 |
| MOD-3B RND 0.88 @ 150 GPM | 80.8 | 7.7 | 42 | 73 | 441 | 2.94 |
| MOD-3B RND 0.88 @ 175 GPM | 93 | 10 | 61 | 87 | 522 | 2.98 |
| MOD-3B RND 0.88 @ 200 GPM | 107 | 12 | 75 | 92 | 566 | 2.83 |

While these embodiments have been described with emphasis on the embodiments, it should be understood that within the scope of the appended claims, the embodiments might be practiced other than as specifically described herein.

What is claimed is:

1. An apparatus for mixing fluids comprising:

a. a mixing housing with a first end and a second end, a central axis between the first end and the second end, and a flaring inner cavity, the flaring inner cavity expanding in radius from the first end to the second end forming an outlet adjacent to the second end with an outlet central axis axially aligned with the central axis;

b. a radial inlet having a radial inlet axis formed in a wall of the mixing housing, wherein the radial inlet axis is at an acute angle to the central axis of the mixing housing, and further wherein the radial inlet is configured to provide fluid to the flaring inner cavity and create spiraling turbulent flow of the fluid; and c. an inlet nozzle extending at least partially into the flaring inner cavity from the first end of the mixing housing wherein the inlet nozzle has an inlet central axis axially aligned with the central axis of the first end of the mixing housing, and further wherein the inlet nozzle extends into the flaring inner cavity and the inlet nozzle comprises an inlet nozzle end adjacent a converging section of the inlet nozzle and a nozzle outlet end adjacent a straight section of the inlet nozzle, wherein the nozzle outlet end comprises a projection extending into the flaring inner cavity; and wherein the inlet nozzle and the radial inlet are configured to cooperatively provide fluid to the flaring inner cavity to create a continuous turbulent flow of the fluid within the flaring inner cavity.

2. The apparatus of claim 1, further comprising a plurality of radial inlets.

3. The apparatus of claim 1, wherein the radial inlet is spiraled.

4. The apparatus of claim 1, wherein the inlet nozzle is integral with the mixing housing.

5. The apparatus of claim 1, wherein the inlet nozzle is connected with the mixing housing.

6. An apparatus for mixing fluids comprising:

a. a mixing housing with a first end and a second end, a central axis between the first end and the second end, and a flaring inner cavity, the flaring inner cavity expanding in radius from the first end to the second end forming an outlet adjacent to the second end with an outlet central axis axially aligned with the central axis;

b. a radial inlet having a radial inlet axis formed in a wall of the mixing housing, wherein the radial inlet axis is at an acute angle to the central axis of the mixing housing; and c. an inlet nozzle adjacent the first end of the mixing housing, wherein the inlet nozzle at least partially extends into the flaring inner cavity from the first end of the mixing housing, the inlet nozzle having an inlet nozzle end adjacent a converging section and a nozzle outlet end adjacent a diverging section of the inlet nozzle, wherein the nozzle outlet end comprises a projection extending into the flaring inner cavity, and wherein the inlet nozzle with the converging section and the diverging section and the radial inlet provide fluid to the flaring inner cavity creating spiraling turbulent flow of the fluid within the flaring inner cavity.

7. The apparatus of claim 6, further comprising a plurality of radial inlets.

8. The apparatus of claim 6, wherein the radial inlet is spiraled.

9. The apparatus of claim 6, wherein the inlet nozzle is integral with the mixing housing.

10. The apparatus of claim 6, wherein the inlet nozzle is connected with the mixing housing.

* * * * *